US006748609B1

(12) United States Patent
Garigan

(10) Patent No.: US 6,748,609 B1
(45) Date of Patent: Jun. 15, 2004

(54) CLOSURE DEVICE FOR A PROTECTIVE SUIT

(75) Inventor: Meave Garigan, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/429,341

(22) Filed: Apr. 28, 2003

(51) Int. Cl.[7] ..... A41D 13/00
(52) U.S. Cl. ..... 2/457
(58) Field of Search ..... 2/457, 69, 456, 2/2.15, 69.5, 458, 78.3, 79, 81, 82, 93, 159, 167, 84, 901, 270, 275

(56) References Cited

U.S. PATENT DOCUMENTS 3,515,798 A * 6/1970 Sievert ..... 174/135
4,901,370 A * 2/1990 Suda ..... 2/457
4,932,078 A * 6/1990 Jones et al. ..... 2/70
5,501,679 A * 3/1996 Krueger et al. ..... 604/393
6,047,413 A * 4/2000 Welchel et al. ..... 2/457
6,286,144 B1 * 9/2001 Henderson et al. ..... 2/69
6,455,779 B1 * 9/2002 Jones ..... 174/93
6,460,198 B1 * 10/2002 Dilworth et al. ..... 2/457

* cited by examiner

*Primary Examiner*—Tejash Patel
(74) *Attorney, Agent, or Firm*—Harvey A. Gilbert; Donald G. Peck

(57) ABSTRACT

A method and combination creates an air tight CBR impervious barrier for combatants. Protective garments including a protective overgarment, gloves, and over-boots are donned. The protective garments have an annular drawstring interface between a hooded-coat and trousers of the protective overgarment, an annular interface between each sleeve of the hooded-coat and each glove, and an annular interface between each leg portion of the trousers and each over-boot. Dilating elastomeric sheaths to an extended or stretched disposition and placing each elastomeric sheath over a separate one of the interfaces allow constricting of each elastomeric sheath over a separate one of the interfaces and compressedly engaging of the interfaces and the wearer's body by the constricting elastomeric sheaths to create an air-tight CBR impervious barrier at the interfaces. Elastomer, adhesive, or other coatings can be on inside surfaces of elastomeric sheaths to create better friction surfaces.

2 Claims, 4 Drawing Sheets

CLOSURE DEVICE FOR A PROTECTIVE SUIT

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to an aid for protective garments. More particularly, this invention is to a method and device for interfacing protective garments to create an impermeable barrier for Chemical Biological Radiological (CBR) agents that prevents contamination of the skin during operations in hazardous environments.

The interfaces between protective gamlents (e.g., pant to boot, sleeve to glove, etc.) are the most vulnerable to CBR contamination during operations in a toxic environment. There is no established method for protecting these closures. Often, users in the field will apply duct tape to these closures to gain some level of protection. However, the efficacy of this method has not been determined and is suspect.

Thus, in accordance with this inventive concept, a need has been recognized in the state of the art for a method and device for expeditiously creating a CBR impermeable barrier between protective garments that prevents skin contamination in hazardous environments.

OBJECTS AND SUMMARY OF THE INVENTION

An object of the invention is to provide a method and combination for creating an impermeable barrier for CBR agents between protective garments.

Another object of the invention is to provide a method and combination for quickly creating an impermeable barrier between protective garments.

Another object of the invention is to provide a method and combination for making an impermeable barrier between protective garments that gives users effective and consistent cutaneous protection without requiring changes to existing equipment or mission protocol.

Another object is to provide a method and system for creating an airtight, CBR resistant interface between protective garments that allows the user freedom of movement.

Another object of the invention is to provide an airtight, CBR resistant interface between protective garments that is easily applied, fits a reasonable range of sizes and does not require modification of existing equipment.

Another object of the invention is to provide a CBR resistant interface between protective garments being reliable and repeatable.

Another object of the invention is to create an airtight, CBR resistant barrier by elastically shrinking or contracting a chemically or mechanically dilated elastomeric sheath around an interface between protective garments.

Another object of the invention is to create an airtight, CBR resistant interface between protective garments that does nor require excessive time or application of heat.

These and other objects of the invention will become more readily apparent from the ensuing specification when taken in conjunction with the appended claims.

Accordingly, the present invention is to a method and combination for providing an airtight, CBR resistant interface between protective garments worn in hazardous environments by workers and combatants. Protective garments including a protective overgarment, gloves, and over-boots are donned. The protective garments have an annular drawstring interface between a hooded-coat and trousers of the protective overgarment, an annular interface between each sleeve of the hooded-coat and each glove, and an annular interface between each leg portion of the trousers and each over-boot. Dilating elastomeric sheaths by chemical or mechanical means to an extended or stretched disposition and placing each elastomeric sheath over a separate one of the interfaces allow for a constricting of each elastomeric sheath over a separate one of the interfaces and compressedly engaging of the interfaces and the wearer's body by the constricting elastomeric sheaths to create an air-tight CBR impervious barrier at the interfaces. Elastomer, adhesive or other coatings can be on inside surfaces of elastomeric sheaths to create better friction surfaces.

DESCRIPTION OF THE PREFERRED EMBODIMENTS

Figure 1:
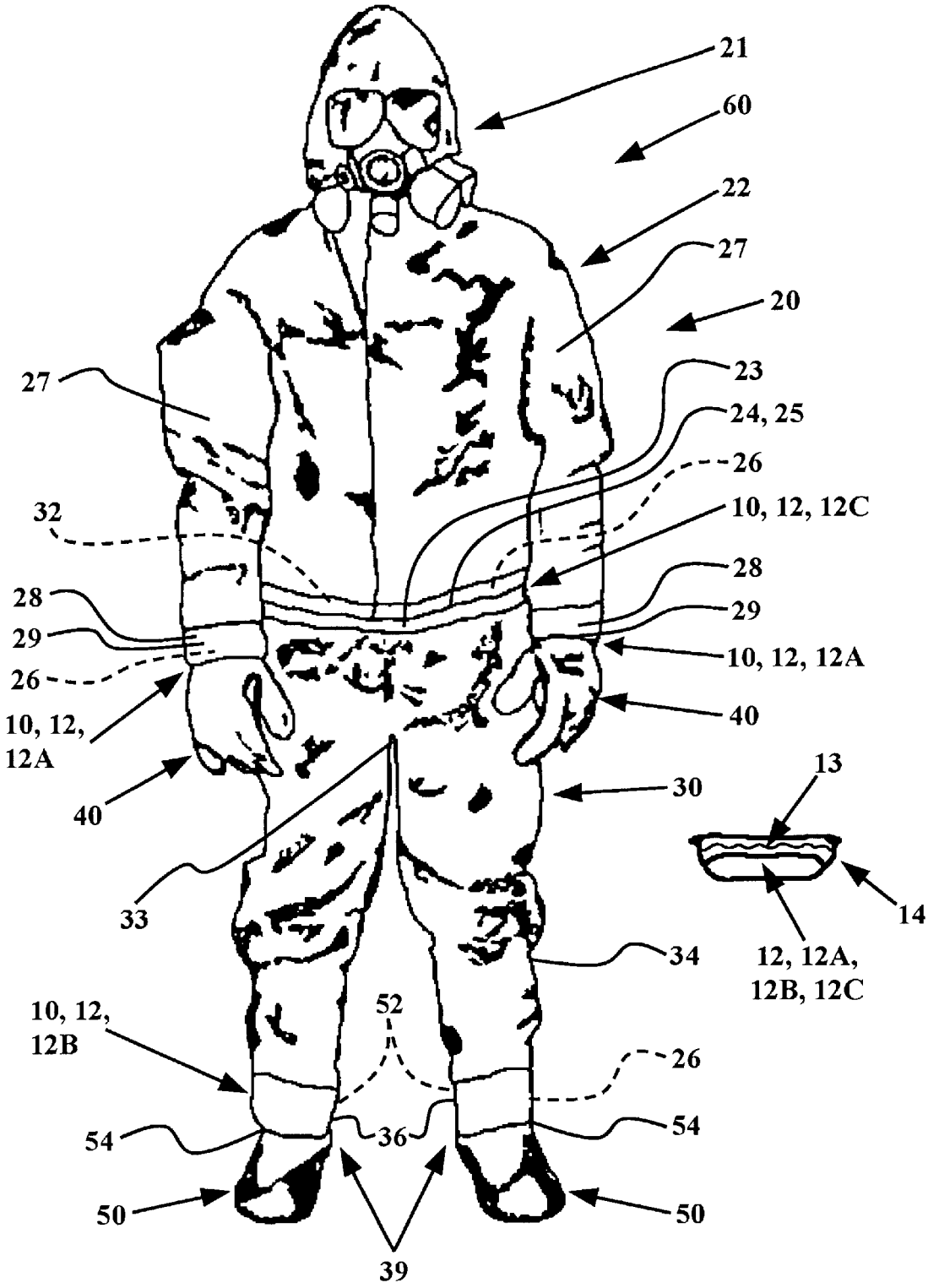
FIG. 1 schematically shows a CBR protective overgarment worn by a combatant or other worker engaged in hazardous activities having impervious elastomeric sheaths closing interfaces adjacent gloves and overboots and between a hooded coat and trousers.

Referring to FIG. 1 of the drawings, impermeable flexible barriers 10 of the invention extend between garments worn by workers or combatants 60 worn in an area contaminated or threatened to be contaminated by Chemical Biological Radiological (CBR) agents. Impermeable flexible barriers 10 and the garments worn (including a protective overgarment 20, gloves 40 and over-boots 50) have sufficient flexibility to permit the performance of tasks in the hazardous environments, and yet provide air-tight effective and consistent cutaneous protection from CBR agents during performance of these tasks.

Protective overgarment 20 can be a two-piece hooded coat 22 and trousers 30 that are worn over the duty uniform. Hooded coat 22 and trousers 30 are constructed of woven material similar to that of a combat uniform and are lined with a charcoal impregnated cloth which provides CBR protection. Hooded coat 22 can accommodate a sealed facemask/breathing-canister assembly 21 and has a sufficient downward overlap on an annular lower portion 23 that hangs over an annular upper portion 32 of trousers 30. A drawstring 24 extends around a lower lip 25 of annular lower portion 23 and through crotch 33 of trousers 30. Drawstring 24 is drawn-up and tightened around annular upper portion 32 and crotch 33 of a wearer to hold coat 22 and trousers 30 together 5 and to prevent coat 22 from riding up on trousers 30 during the performance of arduous tasks. Drawing-up drawstring 24 does provide a degree of CBR protection along the juncture-interface of drawstring 24. Addition of impermeable flexible barrier 10 as described will further assure a sealed interface along drawstring 24.

Figure 2:
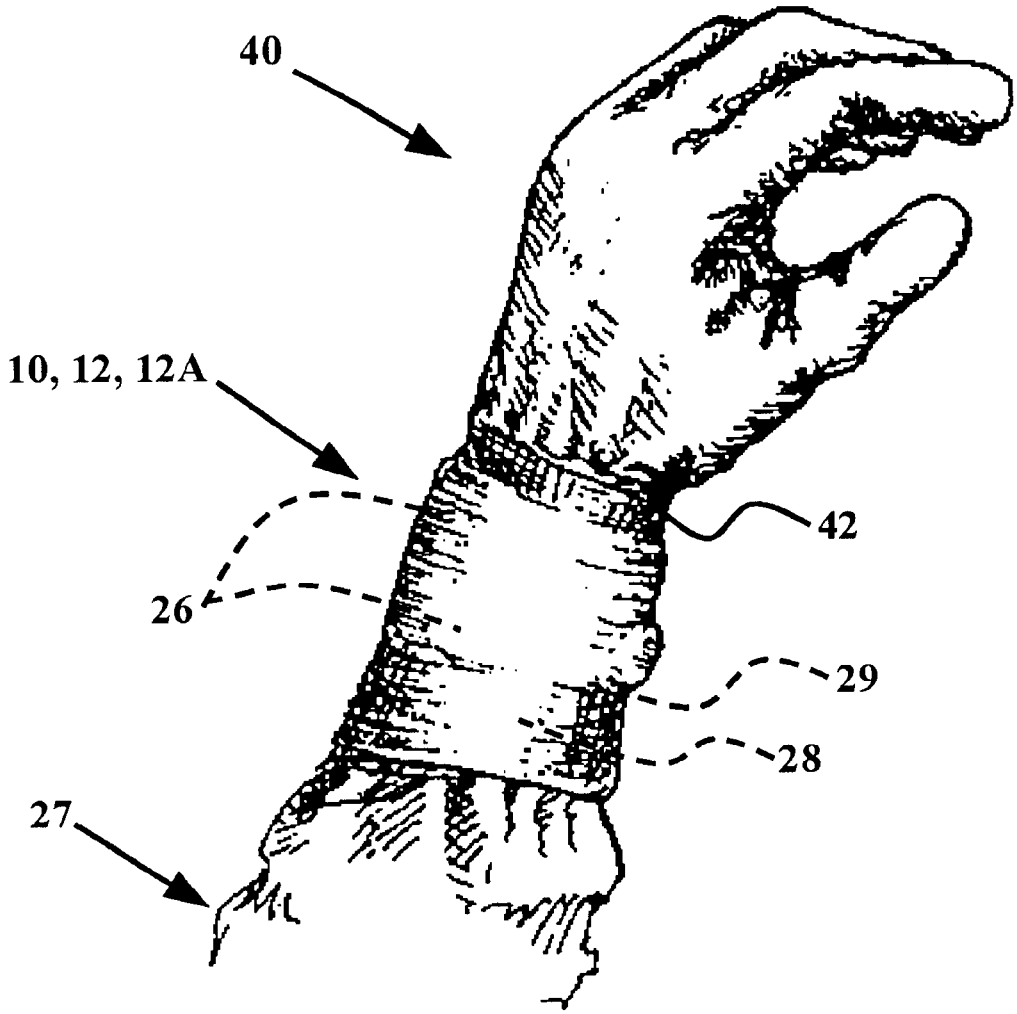
FIG. 2 schematically shows an elastically contracted elastomeric sheath closing the interface between a gloved hand and the sleeve of a protective overgarment.
Figure 3:
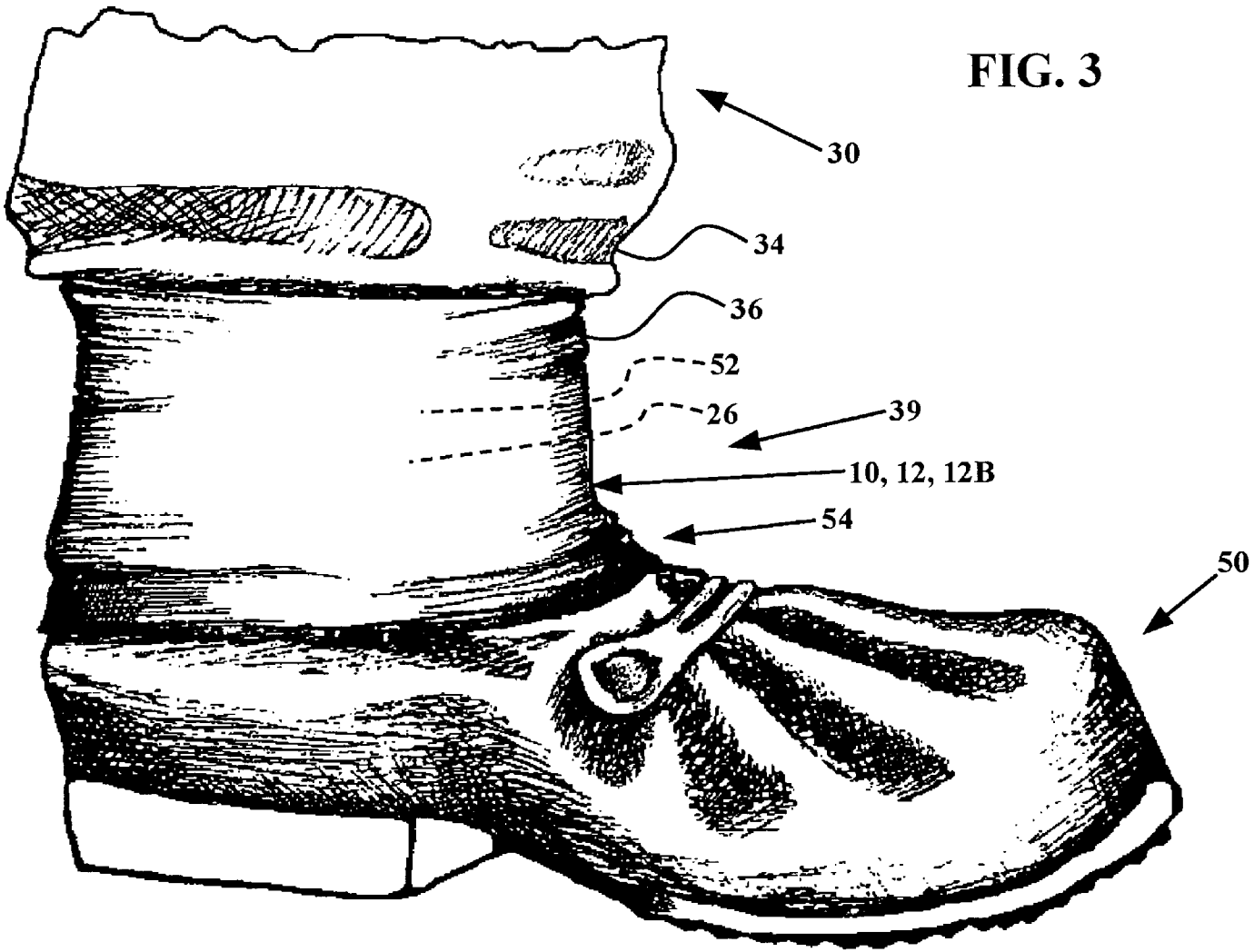
FIG. 3 schematically shows an elastically contracted elastomeric sheath closing the interface between an overboot and a leg portion of trousers of a protective overgarment.

Referring also to FIGS. 2 and 3, protective overgarment 20 is intended to be reusable over a limited period, and gloves 40 are made of butyl rubber with a matte finish that are sometimes worn with cotton glove liners. Each sleeve 27 of coat 22 is worn over a cuff 42 of each glove 40, and the lower edge of an annular lower outer surface part 28 at the lower end of each sleeve 27 defines an external annular wrist interface 29.

Over-boots 50 are worn over conventional footwear and are made from rubber material of heavier gauge than the rubber material of gloves 40. Each leg portion 34 of trousers 30 is worn over a shaft portion 52 of each over-boot 50, and a lower edge of lower surface part 36 of each leg portion 34 defines an external annular ankle interface 39.

Each impermeable flexible barrier 10 can be an elastomeric sheath 12 used one-time use and sized to contract to compressedly engage a wearer's body and parts of protective overgarment 20, gloves 40, and over-boots 50 that are sandwiched between. Elastomeric sheaths 12 can have different sized diameters and lengths (such as elastomeric sheaths 12A, 12B and 12C to be, described) to accommodate different articulating portions of a wearer's body. For examples, each impermeable flexible barrier 10 at external annular wrist interface 29 can be an elastomeric sheath 12A having a diameter for compressedly engaging the wrist of a wearer with a substantially radially inwardly contracting force and a sufficient length to extend from annular lower surface part 28 of each sleeve 27, across an external annular wrist interface 29 and onto cuff 42 of each glove 40. Each impermeable flexible barrier 10 at external annular ankle interface 39 can be an elastomeric sheath 12B having a diameter for compressedly engaging the ankle of a wearer with a substantially radially inwardly contracting force and a sufficient length to extend from lower surface part 36 of each leg portion 34, across an external annular ankle interface 39 and onto a lower part 54 of each shaft portion 52 of each over-boot 50. An impermeable flexible barrier 10 at the juncture-interface of drawstring 24 can be an elastomeric sheath 12C having a diameter for compressedly engaging the waist of a wearer with a substantially radially inwardly contracting force and a sufficient length to extend from annular lower portion 23 of hooded coat 22, across the juncture-interface of drawstring 24, and onto annular upper portion 32 of trousers 30. Elastomeric sheaths 12A for annular wrist interface 29, elastomeric sheaths 12B for annular ankle interface 39, and elastomeric sheath 12C for the juncture interface of drawstring 24 are differently sized to accommodate the regions of the wrists, ankles, and waist, but otherwise are of the same construction. Articulating motion at the wearer's ankles, wrists, and waist is not restricted by elastomeric sheaths 12A, 12B, and 12C.

Under normal use, elastomeric sheaths 12A, 12B and 12C should provide an adequate friction surface to help provide an air-tight seal along their respective interfaces 29, 39 and 24. Optionally, if desired, A softer elastomer or adhesive coating 26 may be used to line the inside surfaces of elastomeric sheaths 12A, 12B, and 12C to help assure an air-tight CBR impervious closure of each annular wrist interface 29, each annular ankle interface 39 and along the juncture-interface of drawstring 24, respectively. Softer elastomeric or adhesive coatings 26 can provide better friction surfaces for engaging parts of the protective garments than elastomeric sheaths 12A, 12B and 12C. However, softer elastomeric/adhesive coating 26 should be on the inside surfaces of each elastomeric sheath 12A, 12B, 12C. The softer elastomer should not be on surfaces exposed to CBR agents since the softer material does not provide the best CBR protection and is vulnerable to abrasion Elastomeric sheaths 12A, 12B, 12C of annular flexible barrier 10 can be pre-formed and placed over annular interfaces 29, 39, 25 and shrunk to conform to the wearer's body contours to create an impermeable barrier across them. Elastomeric sheaths 12A, 12B, 12C for annular flexible barriers 10 also can be made available in various sizes for different sized wearers and kept in inventory for extended periods of time.

Numerous techniques could be fabricated to quickly stretch an elastomeric sheath 12 and fit it over a clothing interface in accordance with this invention. The elastically shrinking or contracting of chemically or mechanically dilated elastomeric sheaths around rigid structures is known for applying constricting sheaths around rigid structural components in the electrical connector and pipe-fitting arts but these techniques have not been applied to making flexible articles of clothing impermeable to CBR agents in accordance with this invention.

For example, the invention of U.S. Pat. No. 6,455,779 discloses a splice connector for covering the rigid junction between two cables attached to rigid interfitting connectors. The splice connector has chemically dilated and shrinkable elongated annular sleeves made from high density natural or synthetic swellable rubber materials that are expandable or dilated by contact with an expanding chemical agent and shrinkable upon removal of contact with the chemical agent. Suitable rubber materials include EPDM rubber, neoprene or chlorosulfonate polyethylene rubber. The rubber can be easily swollen initially by immersing it in any of a variety of known swelling agents, such as benzene, toluene or a xylene. The dilated sleeves are removed from the swelling agent and slid over the connector parts. After being removed from the swelling agent for a relatively short period of time, the sleeves contract, or shrink inwardly onto the rigid connection to form a protective cover.

A known structure for mechanically dilating and shrinking elastomeric bands has found application in corrosion prevention for welded pipe joints. U.S. Pat. No. 3,515,798 discloses a rubbery or elastically shrinkable tubular cover member supported in a radially expanded or stretched condition on a removable rigid spiral core. After the resilient cover member on the spiral core has been placed to cover a welded joint, the spiral core may be removed by a simple hand operation. The adjacent coils of the spiral core are uncoiled and removed as a continuously extending narrow strip through the remainder of the spiral that still supports the stretched cover member. This permits the resilient cover member to be progressively shrunk-fit onto the welded joint. No lubricants, friction-reducing materials or other tools are needed to remove the core support and permit contraction of the stretched cover member onto the joint.

These proven techniques of the prior art can be advantageously relied upon to quickly give needed protection for personnel exposed to highly dangerous, CBR-contaminated environments. Upon receiving warning of a CBR threat, each combatant 50 quickly dons protective garments including protective overgarment 20, gloves 30 and over-boots 40. Each elastomeric sheath 12 of impermeable flexible barrier 10 is removed from its individual air-tight package 14 (for example, a flexible plastic-like bag having an individual elastomeric sheath 12 inside can be sealed by application of heat, for example, to create an air tight pouch or package). If swellable elastomeric sheaths 12 are used, then elastomeric sheaths 12 (12A) are removed from a swelling agent 13 inside of each air-tight package or pouch 14. While elastomeric sheaths 12A are immersed in swelling agent 13 and shortly thereafter, they are loose enough to be slid or placed onto each sleeve 22 of protective overgarment 20 to extend from annular lower surface part 28 of each sleeve 27, across an external annular wrist interface 29 and onto cuff 42 of each glove 40. After the relatively short period of time of a few minutes e.g., in the range of less than five minutes, they shrink or contract to snugly and securely engage the regions of the garments and the wearer's body beneath at and around external annular wrist interfaces 29 to provide a compressedly engaging barrier for CBR agents.

While other ones of elastomeric sheaths 12 (12B) are immersed in swelling agent 13 in individual sealed pouches or packages 14 and shortly thereafter, they are loose enough to be slid onto each leg portion 34 of protective overgarment 20 to extend from lower surface part 36 of each leg portion 34, across an external annular ankle interface 39 and onto lower part 54 of each shaft portion 42 of each over-boot 40. After a relatively short period of less than five minutes, they shrink or contract radially inwardly to snugly and securely, compressedly engage the regions of the garments and the wearer's body beneath at and around external annular ankle interfaces 39 to provide a barrier for CBR agents. An appropriately sized elastomeric sheath 12C is taken from swelling agent 13 in its individual package 14 and is slid over a wearer's feet, legs and hips until it covers drawstring interface 24 and extends over the regions of the coat 22 and trousers 32 adjacent interfaces 24. During the next few minutes, swellable elastomeric sheath 12C contracts radially inwardly to snugly and securely engage drawstring interface 24 and the wearer's body beneath to create a compressedly engaging impermeable barrier for CBR agents.

Elastomeric sheaths 12A, 12B, and 12C have different diameters and lengths for annular wrist interfaces 29, annular ankle interfaces 39, and drawstring interface 24 to respectively accommodate the regions of the wrists, ankles and waist, but otherwise they have a constituency that is virtually the same and articulating motions at the ankles, wrists and waist are not overly restricted. The flexible barriers for CBR agents are quickly made without needing other support equipment.

A mechanical dilation or stretching structure can be selected for application of annular elastomeric sheaths 12. Elastomeric sheaths 12 can be stretched over removable rigid spiral cores like that disclosed in the above identified U.S. Pat. No. 3,515,798. Stretched elastomeric sheaths 12A can be slid onto each sleeve 22 of hooded coat 22 to extend from annular lower outer surface 28 of each sleeve 27, across an external annular wrist interface 29 and onto cuff 42 of each glove 40. The spirals are unwound and stretched elastomeric sheaths 12A shrink or contract to engage the adjacent garments and cover each wrist interface 29. The same procedure is used to apply elastomeric sheaths 12B and 12C; however, differently sized spiral cores must be used to accommodate the differently sized body members and sheaths.

Other techniques for stretching elastomeric sheaths 12 and fitting them in place can be done. For example, hydraulic and/or inflation means and techniques can be used to quickly stretch and apply elastomeric sheaths 12 in the manner disclosed herein.

The elastomeric sheaths of impermeable flexible barrier 10 are an improvement over using heat shrinkable tubing that has been used in the prior art to cover rigid connections. Heat shrinkable tubing of the prior art is made of thermoplastic polymeric materials which, when subjected to elevated temperatures, shrink and contract around a rigid connection. While such heat shrink tubing has proved more effective than tape wrapping in some rigid electrical connections, it is not suitable for making a flexible impermeable closure for protective garments since shrink tubing still has a number of serious deficiencies. For instance, heat shrinking takes a considerable amount of time for the large diameter, relatively thick wall tubing necessary to use with large diameter cable connectors. An inordinate amount of time must subsequently be spent slowly shrinking the heat shrink tubing to fit, and heat shrinking cannot be expedited by applying additional heat. This is because additional heat will char and/or damage the plastic tubing, rather than appreciably speeding the shrinking process, and the excessive heat may also damage other components associated with the tubing, i.e., the protective garments disclosed herein. In addition, the heat-shrunk tubing becomes hardened and loses flexibility, and at remote locations, a suitable source of heat may not be available.

Figure 4:
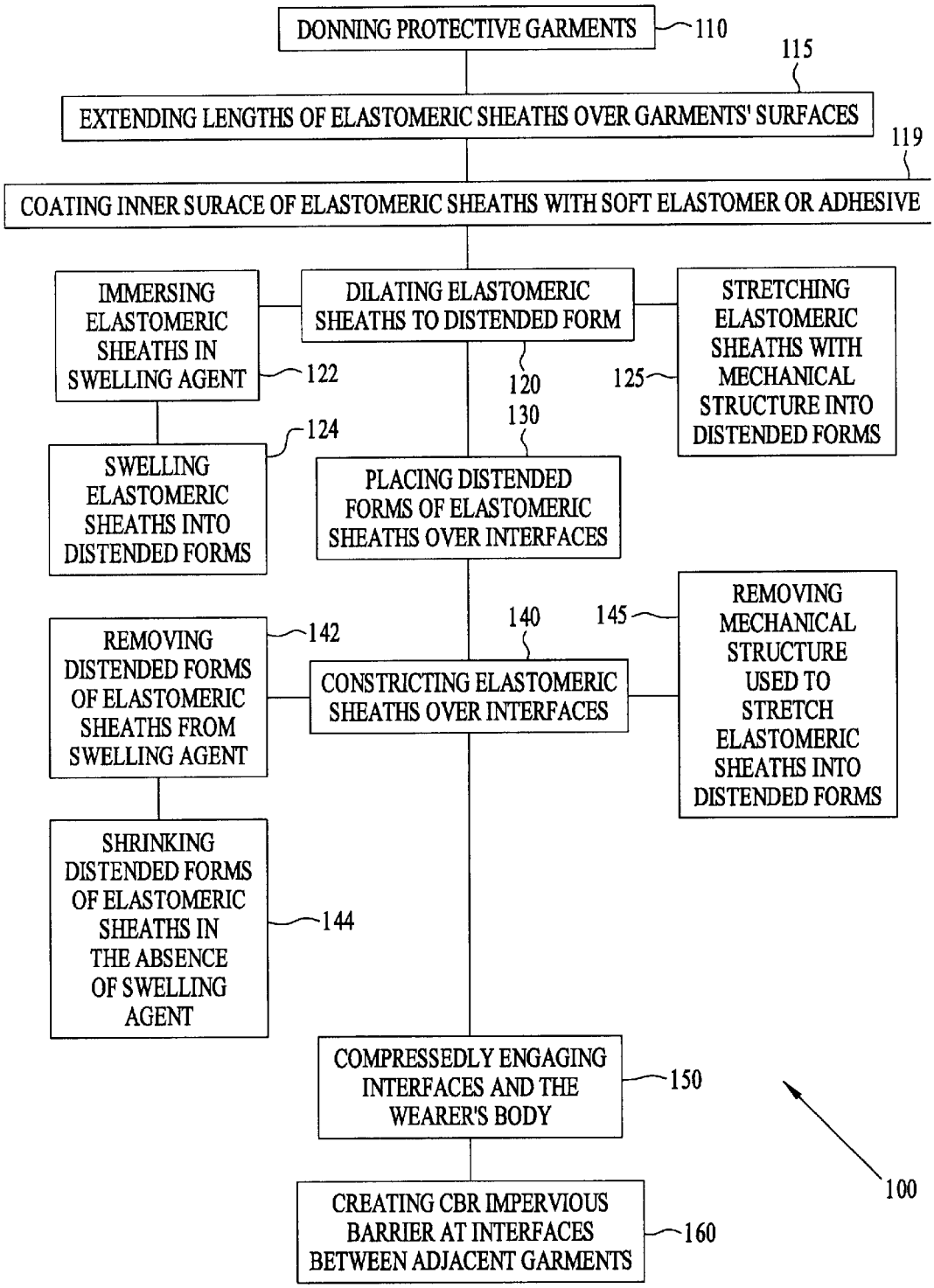
FIG. 4 schematically shows the method of making a CBR resistant barrier between protective garments that gives users effective and consistent cutaneous protection.

Referring to FIG. 4, a method 100 of creating a CBR impermeable barrier for combatants 60 (or workers) in a CBR environment has them each donning 110 protective garments (including protective overgarment 20, gloves 40, and boots 50) that cover each wearer's body. The protective garments have an annular drawstring interface 24 between hooded-coat 22 and trousers 30 of protective overgarment 20, an annular interface 29 between each sleeve 27 of hooded-coat 22 and each glove 40, and an annular interface 39 between each leg portion 34 of trousers 30 and each boot 50. Extending 115 the length of separate elastomeric sheaths 12 allows them to each reach over annular surfaces of the protective garments on either side of each annular interface 24, 29 or 39. Coating 119 with an adequate friction surface, such as an adhesive or soft elastomer on the inner surfaces of elastomer sheaths 12 further assures CBR resistant barriers. Elastomeric sheaths 12 then are subjected to dilating 120 to bring them to distended forms. Dilating 120 can be done by immersing 122 elastomeric sheaths 12 in a swelling agent 13 in a sealed pouch 14 and swelling 124 the immersed elastomeric sheaths 12 in swelling agent 13 into the distended forms. Or, dilating 120 to the distended forms can be performed by stretching 125 elastomeric sheaths 12 with mechanical structure into the distended forms. Placing 130 each of the elastomeric sheaths 12 in their distended forms over a separate one of interfaces 24, 29, and 39 permits a constricting 140 the distended form of each elastomeric sheath 12 radially inwardly over a separate one of interfaces 24, 29, and 39. Constricting 140 can begin by removing 142 the distended forms of elastomeric sheaths 12 from swelling agent 13 in packages 14 and shrinking 144 the distended forms of elastomeric sheaths 12 in the absence of swelling agent 13. Constricting 140 can also be implemented by removing 145 the mechanical structure that was used to stretch elastomeric sheaths 12 into distended forms to allow each stretched elastomeric sheath 12 to constrict onto a separate one of interfaces 24, 29, and 39. In either case a compressedly engaging 150 of interfaces 24, 29, 39 and the wearer's body by constricting elastomeric sheaths 12 effects creating 160 a CBR barrier at each of interfaces 24, 29, 39 between adjacent garments that coextends with the CBR barrier created by protective overgarment 20, gloves 40, and boots 50.

Having the teachings of this invention in mind, modifications and alternate embodiments of the method and device of impervious barrier 10 can be made without departing from the scope of the invention. Use can be made of known dilating-stretching techniques and devices that may be commercially available off-the-shelf components that are long proven to operate successfully. This can make the invention even more cost-effective and reliable for operational distribution to workers and combatants that must take the risks associated with CBR contaminated environments on land or on open water. Impermeable flexible barrier 10 resists ambient influences and provides long term reliable operation in many operational requirements including saltwater environments.

The disclosed components and their arrangements as disclosed herein, all contribute to the novel features of this invention. Flexible barriers 10 provide combatants 60 a reliable means to remain operational in a highly dangerous CBR environment contaminated or threatened environment. Therefore, impermeable flexible barrier 10, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

I claim:

1. A method of creating an air tight CBR impervious barrier for combatants comprising the steps of:

donning protective garments including a protective overgarment, gloves, and over-boots, said protective garments have an annular drawstring interface between a hooded-coat and trousers of said protective overgarment, an annular interface between each sleeve of said hooded-coat and each glove, and an annular interface between each leg portion of said trousers and each over-boot;

dilating elastomeric sheaths to distended forms, wherein said step of dilating includes the steps of:

immersing said elastomeric sheaths in a swelling agent; and swelling said elastomeric sheaths in said swelling agent into said distended forms;

extending the length of each elastomeric sheath to reach over annular surfaces of said protective garments on either side of each annular interface;

placing each distended form of each elastomeric sheath over a separate one of said interfaces;

constricting each distended form of each elastomeric sheath radially inwardly over a separate one of said interfaces;

compressedly engaging said interfaces and said wearer's body by said constricting elastomeric sheaths; and creating an air-tight CBR impervious barrier at said interfaces.

2. The method of claim 1 wherein said step of constricting includes the step of:

removing said distended forms of said elastomeric sheaths from said swelling agent; and shrinking said distended forms of said swelled elastomeric sheaths in the absence of said swelling agent to allow said step of compressedly engaging.

* * * * *